US005160590A

United States Patent [19]

Totsuka et al.

[11] Patent Number: 5,160,590

[45] Date of Patent: * Nov. 3, 1992

[54] ELECTROLYTIC PROCESSING METHOD FOR ELECTROLYTICALLY PROCESSING METAL SURFACE

[75] Inventors: Nobuo Totsuka; Mitsuo Kimura; Takao Kurisu; Yuji Mishiro; Masakazu Sengan, all of Chiba; Katsunobu Ishizawa, Tokyo; Shigemitsu Kashihara, Tokyo; Minoru Kanazawa, Tokyo; Nagahiro Komatu, Tokyo, all of Japan

[73] Assignees: Kawasaki Steel Corp.; San-ai Oil Co. Ltd., Japan

[ * ] Notice: The portion of the term of this patent subsequent to Mar. 5, 2008 has been disclaimed.

[21] Appl. No.: 770,715

[22] Filed: Oct. 3, 1991

Related U.S. Application Data

[63] Continuation of Ser. No. 403,766, Sep. 6, 1989, abandoned.

[51] Int. Cl.[5] ..... C25D 5/02; C25D 17/00

[52] U.S. Cl. ..... 204/141.5; 204/140; 204/144.5; 204/145 R; 204/146; 204/129.6; 204/147; 205/271; 205/118; 205/305

[58] Field of Search ..... 204/140, 141.5, 144.5, 204/145 R, 146, 49, 55.1, 147, 129.6, 129.65; 205/271, 118, 305

[56] References Cited

U.S. PATENT DOCUMENTS

| | | | |
|---|---|---|---|
| 1,894,670 | 1/1933 | Conlin | 204/144.5 |
| 4,022,676 | 5/1977 | Popescu | 204/55.1 |
| 4,152,224 | 5/1979 | Klein et al. | 204/55.1 |
| 4,406,761 | 9/1983 | Shimogori et al. | 204/144.5 |
| 4,481,089 | 11/1984 | Izumida et al. | 204/144.5 |
| 4,612,094 | 9/1986 | Davenport et al. | 204/141.5 |
| 4,718,992 | 1/1988 | Funahashi et al. | 204/140 |
| 4,728,398 | 3/1988 | Paulet et al. | 204/16 |
| 4,869,792 | 9/1989 | Geus et al. | 204/96 |
| 4,997,529 | 3/1991 | Totsuka et al. | 204/15 |

*Primary Examiner*—John Niebling
*Assistant Examiner*—Arun S. Phasge
*Attorney, Agent, or Firm*—Austin R. Miller

[57] ABSTRACT

An electrolytic processing method for electrolytically processing the surface of a metallic member. A paste containing an electrolyte is prepared by mixing a paste-forming agent with a liquid electrolyte. The paste is placed between the metallic member and an opposing electrode. The metallic member and the opposing electrode are connected to an electrical power supply so that an electrical current is made to flow between the metallic member and the opposing electrode through the paste containing electrolyte, whereby the surface of the metallic member is electrolytically processed. Descaling, passivity treatment, coloring, polishing, plating and other electrolytic process can be performed on any type of metallic member at any desired place, by suitably selecting factors such as the compositon of the paste, condition of the electrical power supply and so forth.

12 Claims, 2 Drawing Sheets

ELECTROLYTIC PROCESSING METHOD FOR ELECTROLYTICALLY PROCESSING METAL SURFACE

This application is a continuation of application Ser. No. 07/403,266, filed Sep. 6, 1989, now abandoned.

BACKGROUND OF THE INVENTION

1. Field of the Invention

The present invention relates to an electrolytic processing method for electrolytically processing the surface of a metallic member, particularly a steel member such as a stainless steel member. More particularly, the invention is concerned with a method which facilitates various electrolytic processing steps such as descaling, polishing, passivity treatment, coloring, plating and so forth to be conducted on a metal surface.

2. Description of the Related Art

Hitherto, mechanical, chemical and electro-chemical techniques have been used for the purpose of conducting various types of processing on the surfaces of metallic products, such as descaling, polishing, passivity treatment, coloring, plating and so forth. These known techniques, however, suffer from the following problems.

For instance, shot-blasting which is a typical example of mechanical descaling techniques is often difficult to conduct due to problems such as generation of dust and noise which seriously impair the working environment. In addition, this technique undesirably allows a work-hardened layer to remain on the surface of the processed product which adversely affects the corrosion resistance and mechanical properties of the product.

Chemical descaling known as pickling or acid cleaning requires a long processing time and encounters difficulty in regard to the disposal of the acidic cleaning solution after use. In recent years, a method has been proposed which makes use of a pickling paste. This method enables efficient pickling of large-sized structural members at the site but still requires an impractically long processing time and tends to cause unevenness in pickling effect.

A typical electro-chemical descaling method is a process known as electrolytic pickling. This technique can considerably shorten the processing time but generally requires a large-sized tank for maintaining a bath in which the object is immersed. The application of this technique is therefore limited.

SUMMARY OF THE INVENTION

Accordingly, an object of the present invention is to provide a surface processing method for metallic members, which eliminates difficulties in processing at the site with various electro-chemical processing techniques such as electrolytic pickling, electrolytic polishing, passivity treatment, electrolytic coloring, electroplating and so on, thereby overcoming the above-described problems of the prior art.

The present inventors have found, through an intense study conducted for the purpose of overcoming the problems of the prior art, that electrolytic processing can effectively and efficiently be conducted on desired portions of structural members at any place, i.e., without requiring the use of an electrolytic solution tank, by making use of a paste of a suitable viscosity level formed from an electrolyte of liquid phase. The present invention is based upon this discovery.

According to the present invention, there is provided an electrolytic processing method for electrolytically processing the surface of a metallic member, comprising the steps of placing a paste containing an electrolyte between the surface of the metallic member to be processed and an opposing electrode, and causing an electric current to flow between the metallic member and the opposing electrode through the paste.

The electrolytic processing method of the present invention can be carried out under a variety of conditions as to polarity of the electrode, paste composition and so forth, to meet a variety of demands such as descaling, passivity treatment, plating and so forth.

Thus, the term "electrolytic processing" of the surface of a metallic member is used in this specification to include various electro-chemical processing techniques conducted on a metal surface, such as descaling by electrolytic pickling, electrolytic polishing, passivity treatment, electrolytic coloring, electro-plating, and so forth.

Any metallic member requiring a surface treatment or processing can be used as the object of the electrolytic processing method of the invention. Examples of the metallic materials suitably processed are steels such as stainless steel, ordinary steel and low alloy steel, non-ferrous metals such as copper, nickel, aluminum, titanium, chromium, and alloys of such ferrous and non-ferrous metals. It is also possible to process the surface of a cladding layer of a composite metallic material.

The electrolytic processing method of the present invention can be conducted on any desired portion of a metallic structural member, regardless of the type of the member and the location of the member, because the method can be carried out without requiring any electrolytic solution tank.

The electrolytic processing method of the present invention makes use of an electrolyte-containing paste in place of the conventional electrolytic solution. The paste poses a greater resistance to the mobility of electrostatic charges of the electrolyte as compared with the liquid-phase electrolyte, so as to eliminate any small fluctuation or unevenness of electrical potential over the surface of the processing object, thereby ensuring that the effect of the electrolytic processing is developed uniformly over the entire area of the surface of the processed object.

Any type of electrolyte which is contained in ordinary electrolytic solutions for various types of electrolytic processing described above and which can easily be formed into a paste can be used as the electrolyte in accordance with the present invention. Various acids, bases, salts and their mixtures can be used as the electrolyte as required.

Any type of electrolyte-containing paste formed by addition of a suitable paste-forming agent can be used as the paste in the present invention, provided that it is electrically conductive, including pastes which are formed from the above-mentioned electrolytes with or without addition of water.

Various paste-forming agents capable of forming a liquid electrolyte into a paste of a suitable viscosity level can be used. Examples of the paste-forming agent are sodium polyacrylate, silicon dioxide, sodium alginate and so forth.

The ratio at which the electrolyte and the paste-forming agent are mixed should be determined such that a predetermined electrical conductivity is obtained between the processed metallic member and the opposing electrode across the paste interposed therebetween. The required level of electrical conductivity varies depending on factors such as the purpose of the electrolytic process, conditions of execution of the electrolytic process and so forth. Therefore, no specific limitation is posed on the ratio at which the paste-forming agent is mixed with the electrolyte.

The viscosity of the electrolyte-containing paste used in the present invention is determined primarily depending on the geometrical condition and/or position of the surface to be processed, i.e., whether the surface is horizontal, vertical or slant, whether only a local portion or the entire surface is to be treated, and so forth. The viscosity is controllable through selection of the kind of the paste-forming agent and/or the ratio at which the paste-forming agent is mixed with the electrolyte and water. Practically, the viscosity is controlled to range between 1,000 and 100,000 cp, in order to ensure that the paste is securely held on the metal surface and to allow relief of gases generated in the course of electrolytic reaction.

In some cases, the surface of the metallic member to be processed exhibits water-repellancy due to, for example, deposition of an oil. In such a case, it is advisable that the paste contains a surfactant or a water- or oil-soluble organic solvent such as an alcohol, a ketone, or a polyhydric alcohol derivative such a propyleneglycol monomethylether. It is also possible to add a polishing agent to the material of the paste. When the paste is intended for use on a metallic material which is liable to be corroded by an acid, e.g., a steel, it is preferred that a corrosion inhibitor is added to the material of the paste.

According to the present invention, any suitable means can be used for supplying and retaining the electrolyte-containing paste in the space between the surface of the metallic member to be processed and the opposing electrode. Preferably, however, the paste is beforehand applied to the surface of the metallic member to be processed or an automatic paste supplying means is used to automatically supply the paste into the gap between the surface of the metallic member and the opposing electrode.

When the paste is applied to the surface of the metallic member to be processed, the application may be conducted by any suitable application method provided that the paste can be applied to a desired portion of the metal surface in a predetermined thickness. For instance, the paste can be applied by means of a brush or spray. It is also possible to apply the paste by allowing the paste to spread through a slit or from a tube.

When an automatic paste supplying device is used, it is preferred that the paste is made to automatically flow into the space between the surface of the metal and the opposing electrode immediately before the execution of the electrolytic process. It is also preferred that the automatic paste supplying device is provided with means for collecting the spread paste so that the paste may be collected for repeated use. Provision of such collecting means effectively prevents scattering of the paste and facilitates cleaning of the metal surface after the electrolytic processing, while eliminating necessity for an additional step of collecting the paste after completion of the electrolytic processing.

Thus, the electrolytic processing method of the present invention is carried out by placing an electrolyte-containing paste between an electrode which is a metallic member having a surface to be processed and an opposing electrode, and allowing an electrical current to flow between these electrodes through the electrolyte of the paste. In order to attain a high efficiency of electrolytic processing, it is preferred that the distance between the metallic member to be processed and the opposing electrode is determined to be several tens of millimeters or less, more preferably 10 mm or less, but short-circuiting between these electrodes is strictly forbidden. It is also preferred that the paste held between both electrodes is spread uniformly so as to provide a uniform conductivity distribution.

Any material which allows an electrical current to flow through the paste between itself and the metallic member can be used as the material of the opposing electrode. Preferably, however, the opposing electrode is made of a material having chemical resistance enough to hold the paste by impregnation. The opposing electrode may be provided with a plurality of electrically insulating projections so as to maintain a predetermined gap between itself and the surface of the metallic member to be processed. This arrangement ensures that a predetermined gap is formed between the opposing electrode and the surface of the metallic member to be processed, so as to avoid any fluctuation of the quality of the treated surface which tends to be caused by preprocessing conducted prior to the electrolytic processing.

Preferably, the opposing electrode is covered by a cover of an insulating material impregnated with the paste. Any electrically insulating material can be used as the material of the cover, provided that it has a mechanical properties high enough to prevent rupture caused by shifting of the electrode or vibration. Examples of the materials suitably used as the materials of the cover are cloths woven from, for example, polyester fibers, glass fibers and alumina fibers, knit cloth, sponge, porous ceramics sinter, a brush-type member and so forth.

According to the invention, it is preferred that a relative movement is caused between the metallic member as the processing object and the opposing electrode. If necessary, the paste held between the metallic member and the opposing electrode is made to flow during the relative movement. This is because the relative movement between the metallic member and the opposing electrode and the flowing of the paste effectively eliminates slight local variation of electrical potential over the surface of the metallic member to be processed.

The relative movement between the metallic member and the opposing electrode or the flowing of the paste may be caused by vibrating one or both of the metallic member and the opposing electrode or causing a relative motion such as relative rotation therebetween.

It will be clear to those skilled in the art that, when the electrolytic processing method of the invention is intended for electro-plating, the paste should contain plating nuclides. In this case, the opposing electrode may be a soluble anode.

The above and other objects, features and advantages of the invention will become clear from the following description of the preferred embodiments.

DESCRIPTION OF THE PREFERRED EMBODIMENTS

Figure 1:
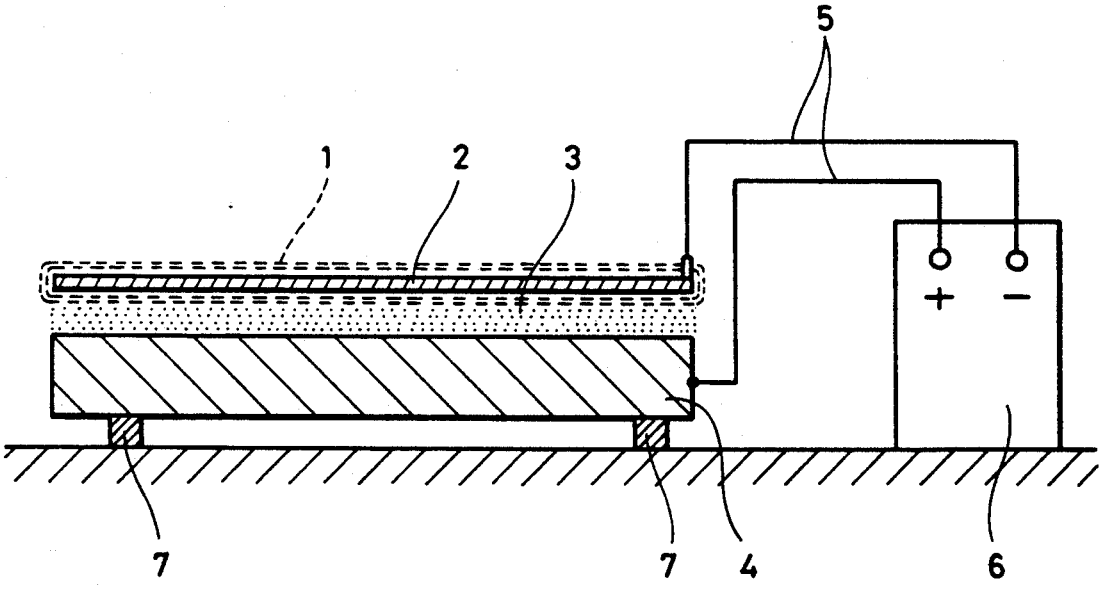
FIG. 1 and FIG. 2 are schematic illustrations of an electrolytic processing apparatus.

The electrolytic processing method has basic features described hereinabove. Practically, however, it is preferred that a specific processing apparatus be used for a specific kind of the electrolytic processing to be conducted. For instance, when the electrolytic processing method of the invention is intended for electrolytic pickling, it is possible to use an electrolytic processing apparatus as shown in FIG. 1 or in FIG. 2.

These apparatus will be detailed in the following description of Examples, which are intended to be illustrative of preferred embodiments of the invention, but which are not intended to limit the scope of the invention, which is defined in the appended claims.

EXAMPLE 1

Application to Descaling

An electrolyte-containing paste was prepared by mixing 10 wt. % of sodium sulfate and 5 wt. % of sodium polyacrylate as the paste-forming agent and 85 wt. % of water. 80 g of this electrolyte-containing paste was uniformly applied to the surface of an as hot-rolled SUS 304 stainless steel plate 6 mm thick, 300 mm long and 300 mm wide. Then, an SUS 316 stainless steel plate 2 mm thick, 300 mm long and 300 mm wide, intended for use as the opposing electrode, was wrapped with a woven cloth of polyester fibers and was placed on the paste such that a gap of 5 mm was left between the opposing electrode and the SUS 304 stainless steel plate to be processed. The stainless steel plate to be processed and the opposing electrode were connected to the anode and the cathode of a D.C. power supply, respectively, and electrical current of 30 A was supplied for 6 minutes. Then, after removal of the paste, the processed stainless steel plate was rinsed with water for observation of the effect of the descaling processing. As a result, a uniform descaling from the stainless steel plate surface was confirmed.

The descaling processing of this example was conducted by means of an electrolytic pickling apparatus of the stationary electrode type which is schematically shown in FIG. 1. Referring to FIG. 1, the electrolytic pickling apparatus of the stationary electrode type has the opposing electrode 2 made of SUS 316 stainless steel and covered by an electrode cover 1. On the other hand, the paste 3 containing sodium sulfate as the electrolyte is applied to the SUS 304 stainless steel plate 4 to be processed. The opposing electrode 2 is placed on the paste such that it opposes the stainless steel plate 4 to be processed across a gap of 5 mm which is filled with the paste 3. The stainless steel 4 to be processed is connected through a line 5 to the anode of the power supply 6 while the opposing electrode 2 is connected to the cathode of the power supply 6 through a line 5, so that electrical current is supplied to flow between the opposing electrode 2 and the stainless steel plate 4 to be processed through the electrolyte-containing paste 3, whereby the electrolytic pickling is conducted.

EXAMPLE 2

Application to Passivity Treatment

Passivity treatment was conducted on two types of test pieces: namely, an SUS 304 stainless steel plate 6 mm thick, 300 mm long and 300 mm wide after a shot blast and a test piece of the same material and size cut from an as hot-rolled sheet.

Figure 2:
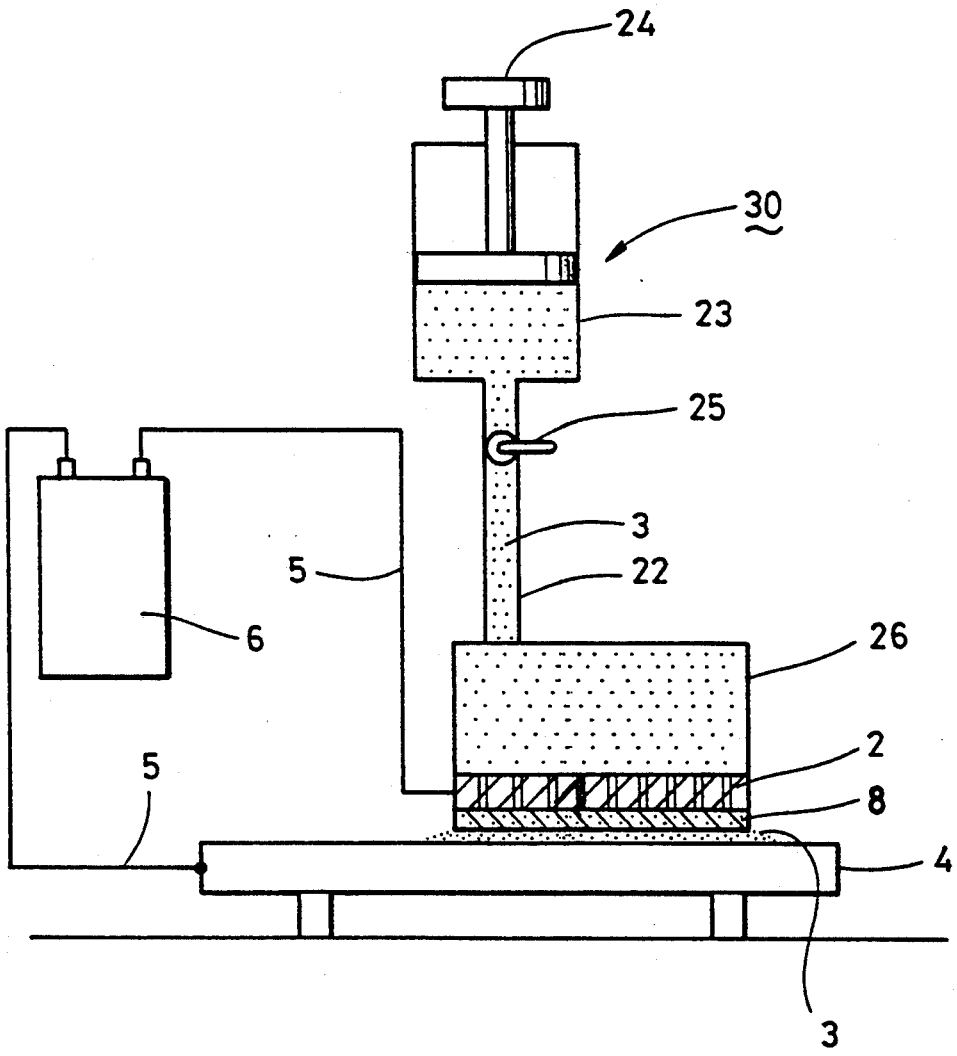

A paste was prepared by adding 5 wt. % of sodium polyacrylate to 95 wt. % of aqueous solution of one, two or more of $Na_2SO_4$, $H_2SO_4$, $NaNo_3$, $HNO_3$ and $H_3PO_4$. The surfaces of the stainless steel test pieces were electrolytically processed using this paste. A schematic illustration of the apparatus used in the Example 2 is shown in FIG. 2. Referring to FIG. 2, the paste supply apparatus 30 comprises a means of compression 24, a paste supply tank 23, a paste supply pipe 22 and a cock 25. The paste 3 is supplied with the amount of supply controlled by the cock 25, through a paste trap 26 and the opposing electrode 2 and held by a pad 8 and from which the paste 3 is impregnated onto the surface of the plate 4. The electrical current from power supply 6 is then supplied through line 5 whereby the steel plate 4 and the opposing electrode 2 are connected to the anode and the cathode of a power supply 6, respectively, so that a passivity treatment is performed on the surface of the steel plate 4. The paste composition, current density, electrolytic processing time and the electricity quantity are shown in Tables 1 and 2.

After the electrolytic processing, a salt spray test as specified in JIS Z 2371 was conducted for 1 week and rusty areas of the test pieces were measured as index of the effect of the passivity treatment. The results also are shown in Tables 1 and 2.

It will be seen from these Tables that the test pieces processed by the method of the invention showed excellent results. Comparison examples, which were processed with a smaller electricity quantity or with a composition ratio below the aforementioned range, showed generation of rust.

TABLE 1

Electrolytic Passivity Treatment Conditions and Results of Salt Spray Test (Blast-Shot Material)

| | Paste condition | Current density ($mA/cm^2$) | Electrolytic processing time (sec.) | Quantity of electricity Coulomb/$cm^2$ | Salt spray |
|---|---|---|---|---|---|
| Invented method | 10% $Na_2SO_4$ | 100 | 30 | 3.0 | ◎ |
| Invented method | 10% $H_2SO_4$ | 100 | 30 | 3.0 | ◎ |
| Invented method | 10% $H_3PO_4$ | 100 | 30 | 3.0 | ◎ |
| Invented method | 10% $HNO_3$ | 100 | 30 | 3.0 | ◎ |
| Invented method | 10% $NaNO_3$ | 100 | 30 | 3.0 | ◎ |
| Invented method | 5% $Na_2SO_4$ + 10% $H_2SO_4$ | 100 | 30 | 3.0 | ◎ |
| Invented method | 5% $H_2SO_4$ + 5% $HNO_3$ | 100 | 30 | 3.0 | ◎ |
| Invented method | 5% $Na_2SO_4$ + 5% $NaNO_3$ | 100 | 30 | 3.0 | ◎ |
| Invented method | 10% $Na_2SO_4$ | 100 | 10 | 1.0 | ○ |
| Invented method | 3% $H_2SO_4$ | 100 | 10 | 1.0 | ○ |
| Invented method | 10% $Na_2SO_4$ | 100 | 15 | 1.5 | ◎ |
| Invented method | 10% $Na_2SO_4$ | 300 | 10 | 3.0 | ◎ |
| Invented method | 20% $Na_2SO_4$ | 500 | 10 | 5.0 | ◎ |
| Invented method | 5% $H_3PO_4$ + 5% $NaNO_3$ + 5% $Na_2SO_4$ | 200 | 10 | 2.0 | ◎ |
| Invented method | 5% $H_3PO_4$ + 5% $NaNO_3$ | 200 | 30 | 6.0 | ◎ |

TABLE 1-continued

Electrolytic Passivity Treatment Conditions and Results of Salt Spray Test (Blast-Shot Material)

| | Paste condition | Current density ($mA/cm^2$) | Electrolytic processing time (sec.) | Quantity of electricity $Coulomb/cm^2$ | Salt spray |
|---|---|---|---|---|---|
| Invented method | 10% $H_3PO_4$ + 5% $Na_2SO_4$ | 300 | 60 | 18.0 | ◎ |
| Invented method | 10% $H_3PO_4$ | 100 | 30 | 3.0 | ◎ |
| Comparison Example | 10% $Na_2SO_4$ | 100 | 5 | 0.5 | Δ |
| Comparison Example | 10% $NaNO_3$ | 200 | 3 | 0.6 | Δ |
| Comparison Example | 10% $H_2SO_4$ | 50 | 10 | 0.5 | Δ |
| Comparison Example | 2.9% $HNO_3$ | 100 | 10 | 1.0 | Δ |
| Comparison Example | As shot | — | — | | X |

◎ No rust generated
○ Slightly rusty (<1%)
Δ Lightly rusty (1~10%)
X Significantly rusty (>10%)

TABLE 2

Electrolytic Passivity Treatment Conditions and Results of Salt Spray Test (As Hot-rolled)

| | Paste condition | Current density ($mA/cm^2$) | Electrolytic processing time (sec.) | Quantity of electricity $Coulomb/cm^2$ | Salt spray |
|---|---|---|---|---|---|
| Invented method | 10% $Na_2SO_4$ | 200 | 60 | 12.0 | ◎ |
| Invented method | 10% $H_2SO_4$ | 200 | 60 | 12.0 | ◎ |
| Invented method | 10% $H_3PO_4$ | 200 | 60 | 12.0 | ◎ |
| Invented method | 10% $HNO_3$ | 300 | 50 | 15.0 | ◎ |
| Invented method | 10% $NaNO_3$ | 300 | 40 | 12.0 | ◎ |
| Invented method | 5% $HNO_3$ + 5% $NaNO_3$ | 300 | 40 | 12.0 | ◎ |
| Comparison Example | 10% $Na_2SO_4$ | 100 | 9 | 0.9 | X |
| Comparison Example | 10% $HNO_3$ | 50 | 10 | 0.5 | X |
| Comparison Example | No paste applied | — | — | — | X |

◎ No rust generated
○ Slightly rusty (<1%)
Δ Lightly rusty (1~10%)
X Significantly rusty (>10%)

From Table 1 it will be appreciated that, for purposes of passivity treatments, sharply improved results are obtained by providing electricity in an amount of at least about 1 $Coulomb/cm^2$ for an electrolytic processing time of at least about 10 minutes, preferably using a current density of about 0.50–0.500 $mA/cm^2$.

EXAMPLE 3

Application to Plating

Description will be given of Examples of electroplating of steel plates with Ni or Zn, conducted in accordance with the electrolytic processing method of the present invention.

Test pieces of a steel, 150 mm long and 150 mm wide, was shot-blasted with #46 $Al_2O_3$ particles, and the thus shot-blast test pieces were subjected to electro-plating conducted with a jig covered by a glass-fiber pad 8 of FIG. 2 under the plating conditions as shown in Table 3.

It was thus confirmed that the electrolytic processing method of the present invention enables plating to be conducted easily on thick metallic sheets. Affinity of the plating layer to the base metal was tested by making use of a cellophane adhesive tape. No exfoliation or separation of the plating layer was observed, thus proving superior affinity of the plating layer. The steel sheets after the plating were checked but no irregularity nor unevenness of plating was observed. The test pieces were cut and the cut surfaces were microscopically observed to check for any irregularity in the thickness of the plating layer, but no substantial variation of the plating thickness was found.

TABLE 3

| | No. | Paste composition (g/l) | Current density ($mA/cm^2$) | Time (sec.) | Plating thickness (μm) |
|---|---|---|---|---|---|
| Invented Method | 1 | $NiSO_4$: 177 $NiCl_2$: 25 $H_3BO_3$: 38 Xanthane gum: 10 | 30 | 60 | 2 |
| | *)2 | $NiSO_4$: 177 $NiCl_2$: 25 $H_3BO_3$: 38 Xanthane gum: 10 | 30 | 180 | 4~5 |
| | 3 | $NiSO_4$: 177 $NiCl_2$: 25 $H_3BO_3$: 38 Xanthane gum: 10 | 50 | 60 | 2~3 |
| | 4 | $NiSO_4$: 177 $NiCl_2$: 25 $H_3BO_3$: 38 Xanthane gum: 10 | 100 | 60 | 3~5 |
| | *)5 | $NiSO_4$: 177 $NiCl_2$: 25 $H_3BO_3$: 38 Xanthane gum: 10 | 150 | 60 | 4~5 |
| | 6 | $ZnCl_2$: 210 KCl: 360 Xanthane gum: 10 | 30 | 60 | 2 |
| | *)7 | $ZnCl_2$: 210 KCl: 360 Xanthane gum: 10 | 30 | 180 | 3~5 |
| | 8 | $ZnCl_2$: 210 KCl: 360 Xanthane gum: 10 | 50 | 60 | 2~3 |
| | *)9 | $ZnCl_2$: 210 KCl: 360 Xanthane gum: 10 | 50 | 180 | 4~5 |
| | 10 | $ZnCl_2$: 210 KCl: 360 | 100 | 60 | 3~5 |

TABLE 3-continued

| No. | Paste composition (g/l) | Current density ($mA/cm^2$) | Time (sec.) | Plating thickness (μm) |
|---|---|---|---|---|
| | Xanthane gum: 10 | | | |

*)Plating conducted after reverse electrolysis (100 $mA/cm^2$ 10 sec).

In the Example 3, the plating was conducted with the use of current densities of about 30–150 $mA/cm^2$ for periods of time in the range of about 60–80 seconds. However, in plating in general, it is desirable that the range of current densities for plating be about 15–250 $mA/cm^2$, for reasons of efficiency. Current densities exceeding the said range will cause burning during plating. Periods of time for plating will be properly determined depending upon plating weight.

As will be understood from the foregoing description, the electrolytic processing method of the present invention makes it possible to process the surfaces of all kinds of metallic members with a reduced cost and at the site where the metallic members are actually used.

Therefore, the electrolytic processing method of the present invention is particularly useful when applied to processing of only one side of a metallic member as in the case of a treatment of cladding layer of a stainless clad steel or to processing of only a portion or portions of a structural member.

The electrolytic processing method of the present invention can be carried out without necessitating any fixed electrolytic equipment. Namely, the electrolytic processing method of the present invention can be carried out simply by an opposing electrode and a paste containing an electrolyte. By suitably selecting the configuration of the opposing electrode and the paste composition, it is possible to effect easily, promptly and uniformly various kinds of electrolytic processing such as electrolytic pickling, passivity treatment, electroplating, electrolytic coloring and electrolytic polishing on the surfaces of all kinds of metallic structural members and products.

For instance, the electrolytic processing method of the invention can effectively be applied to repairing plating for plating a damaged portion of a structural member such as a molten portion or welded portion, as well as for plating of a local portion or the entire portion of a large structure. It is also possible to locally thicken the plating layer.

When a structural member has to be left for a long time before final painting, or when the member has to be stored under a severe storage condition, it is possible to form a durable anti-corrosion under-coat layer regardless of the kinds of the metallic member or structure, by applying a primer or chromate on the plating layer. The corrosion resistance of the under-coat layer can be enhanced by applying chromate to the plating layer and then applying primer on the chromate.

It is also to be noted that Ni plating, conducted on a metallic member in accordance with the electrolytic processing method of the invention prior to the application of the primer, effectively suppresses generation of rust and prevents separation of the coating layer of the primer applied on the Ni plating layer.

Although various currents, processing times, current densities and total coulombs have been disclosed for different kinds of electrolytic processing, these and other conditions may be varied in a preferred manner for specific operations provided an effective amount of electric current is caused to flow for an effective time to perform the electrolytic process.

What is claimed is:

1. An electrolytic processing method for electrolytically processing the surface of a metallic member without requiring the use of any electrolytic solution tank, comprising the steps of:

preparing an electrically conductive paste containing an electrolyte and having a viscosity in the range of 1,000–100,000 cp;

placing said paste having said viscosity between said metallic member and an opposing electrode; said paste being a spreadable non-liquid material wherein said viscosity is sufficient to maintain it supported between the electrode and said metallic member without any other support; said paste extending continuously conductively between said metallic member and said opposite electrode; and causing an effective amount of an electrical current to flow between said metallic member and said opposing electrode through said paste to perform the electrolytic process.

2. The electrolytic processing method according to claim 1, comprising the further step of relatively moving the metallic member and the opposing electrode.

3. The electrolytic processing method according to claim 1, including the further step of causing said paste to flow during flowing of said electrical current.

4. The electrolytic processing method according to claim 1, including the combined steps of effecting relative movement between said metallic member and said opposing electrode, and causing said paste to flow during flowing of said electrical current.

5. An electrolytic processing method according to claim 1, 2, 3 or 4, wherein said opposing electrode is covered by a cover made of an electrically insulating material and having chemical resistance enough to enable said cover to hold said paste by impregnation.

6. An electrolytic processing method according to claim 1, wherein the electrolytic processing is conducted to effect one of electrolytic descaling, passivity treatment and electro-plating.

7. The electrolytic processing method according to claim 1, wherein the processing method is a passivity treatment, and wherein the electrical current is provided for an electrolytic processing time of at least about ten minutes providing electricity in an amount of at least about 1 Coulomb/$cm^2$.

8. The electrolytic processing method according to claim 1, wherein the processing method is a plating method, and wherein said electrical current is caused to flow at a current density of about 15–250 $mA/cm^2$.

9. The method defined in claim 1 wherein said electrically conductive paste has greater resistance than an electrolytic solution to the mobility of the electrostatic charges of the electrolyte.

10. The method defined in claim 1 including the step of controlling the viscosity of said electrically conductive paste to allow relief of gases generated in said electrolytic processing.

11. An electrolytic processing method for electrolytically passivating the surface of a metallic member, comprising the steps of:

preparing a paste having a viscosity ranging from 1,000 to 100,000 cp containing 3 wt. % of at least one or more kinds of ions selected from the group consisting of $SO_4^{2-}$, $NO_3^-$ and $PO_4^{3-}$;

placing said paste between said metallic member and an opposing electrode; and supplying electricity through said paste at a rate of at least about 1.0 Coulomb/$cm^2$ using said metallic member and said opposing electrode as an anode and a cathode, respectively, thereby effecting a passivity treatment on said surface of said metallic member.

12. An electrolytic processing method for electrolytically processing the surface of a metallic member, comprising the steps of:

preparing a plating paste and having a viscosity ranging from 1,000 to 100,000 and containing an electrolyte;

placing said paste between said metallic member and said opposing electrode; and causing an electrical current to flow between said metallic member and said opposing electrode through said paste, by connecting said metallic member and said opposing electrode to the anode and cathode of a power supply.

* * * * *